US011268343B1

(12) United States Patent
Schultz et al.

(10) Patent No.: US 11,268,343 B1
(45) Date of Patent: Mar. 8, 2022

(54) CEMENT PLUG INTERNAL ANTI-ROTATION

(71) Applicants: Alexander Schultz, Montgomery, TX (US); Thomas Banditrat, Houston, TX (US)

(72) Inventors: Alexander Schultz, Montgomery, TX (US); Thomas Banditrat, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/077,118

(22) Filed: Oct. 22, 2020

(51) Int. Cl.
*E21B 33/16* (2006.01)

(52) U.S. Cl.
CPC ..... *E21B 33/167* (2020.05)

(58) Field of Classification Search
CPC ..... E21B 33/16; E21B 33/165; E21B 33/167
See application file for complete search history.

(56) References Cited

U.S. PATENT DOCUMENTS

| | | | | | |
|---|---|---|---|---|---|
| 4,858,687 | A * | 8/1989 | Watson | E21B 33/16 | 166/153 |
| 5,025,858 | A * | 6/1991 | Glaser | E21B 29/00 | 166/153 |
| 5,095,980 | A * | 3/1992 | Watson | E21B 29/00 | 166/153 |
| 5,113,940 | A * | 5/1992 | Glaser | E21B 29/00 | 166/153 |
| 5,246,069 | A * | 9/1993 | Glaser | E21B 17/14 | 166/153 |
| 5,842,517 | A * | 12/1998 | Coone | E21B 33/16 | 166/156 |
| 6,491,108 | B1 | 12/2002 | Slup et al. | | |
| 6,578,633 | B2 | 6/2003 | Slup et al. | | |
| 6,708,768 | B2 | 3/2004 | Slup et al. | | |
| 6,708,770 | B2 | 3/2004 | Slup et al. | | |
| 7,163,066 | B2 | 1/2007 | Lehr | | |
| 7,255,178 | B2 | 8/2007 | Slup et al. | | |

* cited by examiner

*Primary Examiner* — Kipp C Wallace
(74) *Attorney, Agent, or Firm* — Cantor Colburn LLP

(57) ABSTRACT

A plug system includes a locked member of a first plug and a free member of a second plug. The locked member has a first locking end having a first anti-rotation feature. The free member has a second locking end having a second anti-rotation feature. The first anti-rotation feature and the second anti-rotation feature are configured to fit together to resist a rotation between the free member and the locked member to thereby resist rotation of the second plug with respect to the first plug.

15 Claims, 5 Drawing Sheets

CEMENT PLUG INTERNAL ANTI-ROTATION

BACKGROUND

During drilling operations, a casing can be introduced into a wellbore and cemented into place. The cementation process includes lowering a lead plug into the casing to sweep out any fluids from within the casing prior to cementing. After a cement slurry has been introduced into the wellbore by way of the casing, a follow plug is lowered into the casing to sweep the cement slurry out of the casing and into the wellbore. Once the cement has set to secure the casing within the wellbore, the follow plug and lead plug are drilled out using a drill bit or milling device. However, if either the lead plug or follow plug catches on the drill bit, the drill out process can be hampered and/or slowed down.

SUMMARY

Disclosed is a plug system. The plug system includes a locked member of a first plug, the locked member having a first locking end having a first anti-rotation feature, and a free member of a second plug, the free member having a second locking end having a second anti-rotation feature. The first anti-rotation feature and the second anti-rotation feature are configured to fit together to resist a rotation between the free member and the locked member to thereby resist rotation of the second plug with respect to the first plug.

Further disclosed is a method of cementing a casing. A first plug is disposed in the casing, the first plug having a first locking end having a first anti-rotation feature. A second plug is passed through the casing to sweep cement out of the casing, the second plug having a second locking end having a second anti-rotation feature. The first anti-rotation feature is mated to the second anti-rotation feature and an applied torque is applied to the second plug, wherein the first anti-rotation feature and the second anti-rotation feature are mated to resist a rotation between of the second plug with respect to the first plug.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
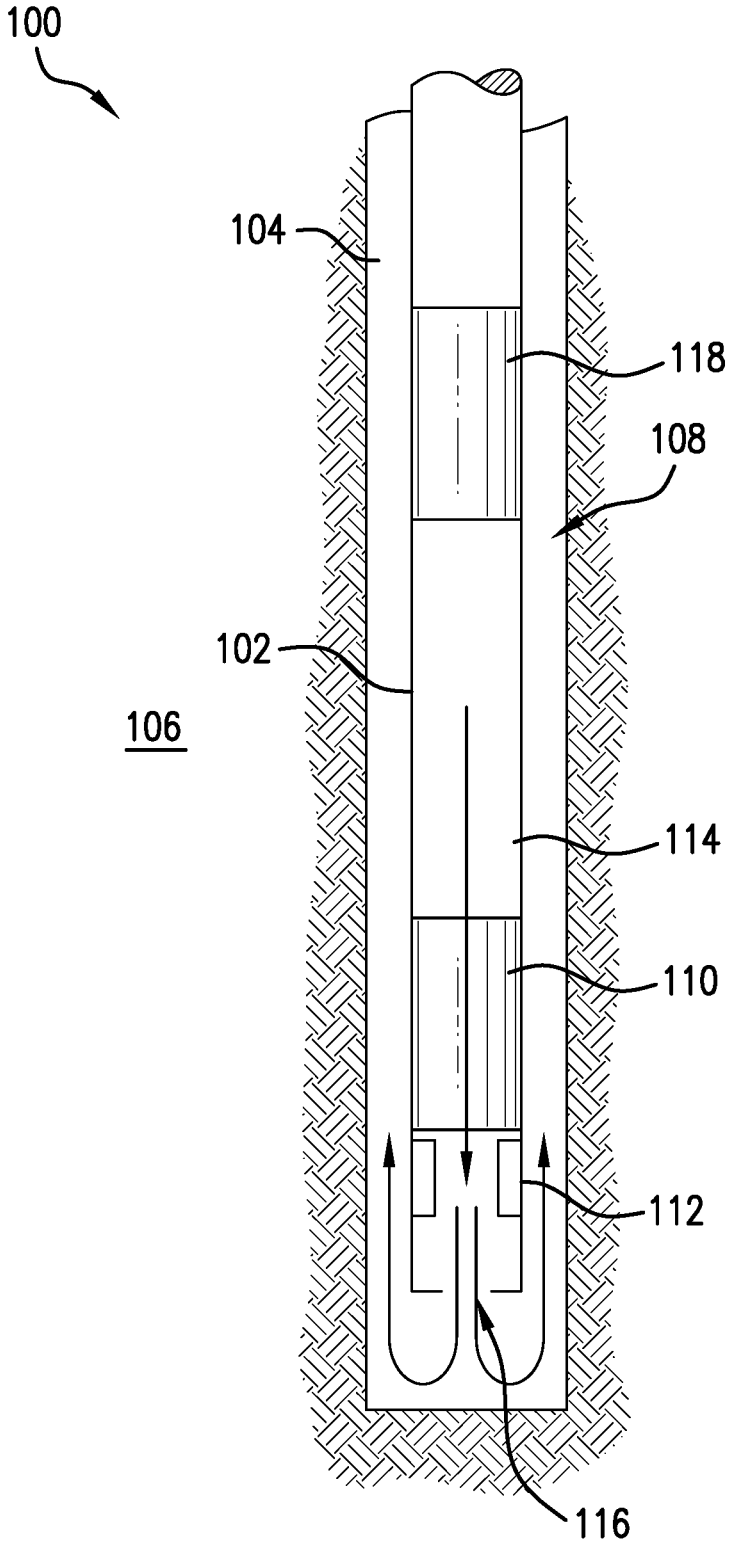
FIG. 1 shows a casing system is shown in an illustrative embodiment.

Referring to FIG. 1, a casing system 100 is shown in an illustrative embodiment. The casing system 100 includes a casing 102 disposed in a wellbore 104 in a formation 106. An annulus 108 is formed in the wellbore 104 between the casing 102 and the formation 106. Cement is introduced into the annulus 108 in order to create a barrier between casing 102 and formation 106. In order to introduce the cement, a first plug, referred to herein as a lead plug 110, is dropped or lowered into the casing 102 from the surface and settles on a locking device 112 at a bottom or lower end of the casing 102. The lead plug 110 generally locks into place or is secured into place at the locking device 112, thereby preventing the lead plug 110 from rotating. A cement slurry 114 is then pumped through the casing 102 to rupture a member in the lead plug 110 to create an opening in the lead plug 110, allowing the cement slurry to pass into the wellbore 104 via the opening and an opening 116 at a bottom end of the casing 102. The cement slurry 114 then flows uphole along the annulus 108. A second plug, referred to herein as a follow plug 118, is lowered onto the cement slurry 114 within the casing 102 and a downward force is applied to the follow plug 118 to sweep the cement slurry 114 into the annulus 108 and uphole. The follow plug 118 eventually settles on the lead plug 110 and the cement slurry 114 is allowed to set within the annulus 108. While the lead plug 110 is locked into the casing 102 via the locking device 112, the follow plug 118 is free to rotate. Once the cement has set, a drill string and drill bit (not shown) are lowered into the casing 102 to drill out the follow plug 118 and the lead plug 110. During drill out, the drill bit rotates and applies a torque to the follow plug 118 and lead plug 110. Without any anti-rotation constraint, the follow plug 118 can catch on the drill bit and rotate along with the drill bit, thereby slowing down or stopping the process of drilling out the follow plug 118. An anti-rotation device, discussed below with respect to FIGS. 2-5, prevents the torque applied by the drill bit from causing the follow plug 118 to rotate.

Figure 2:
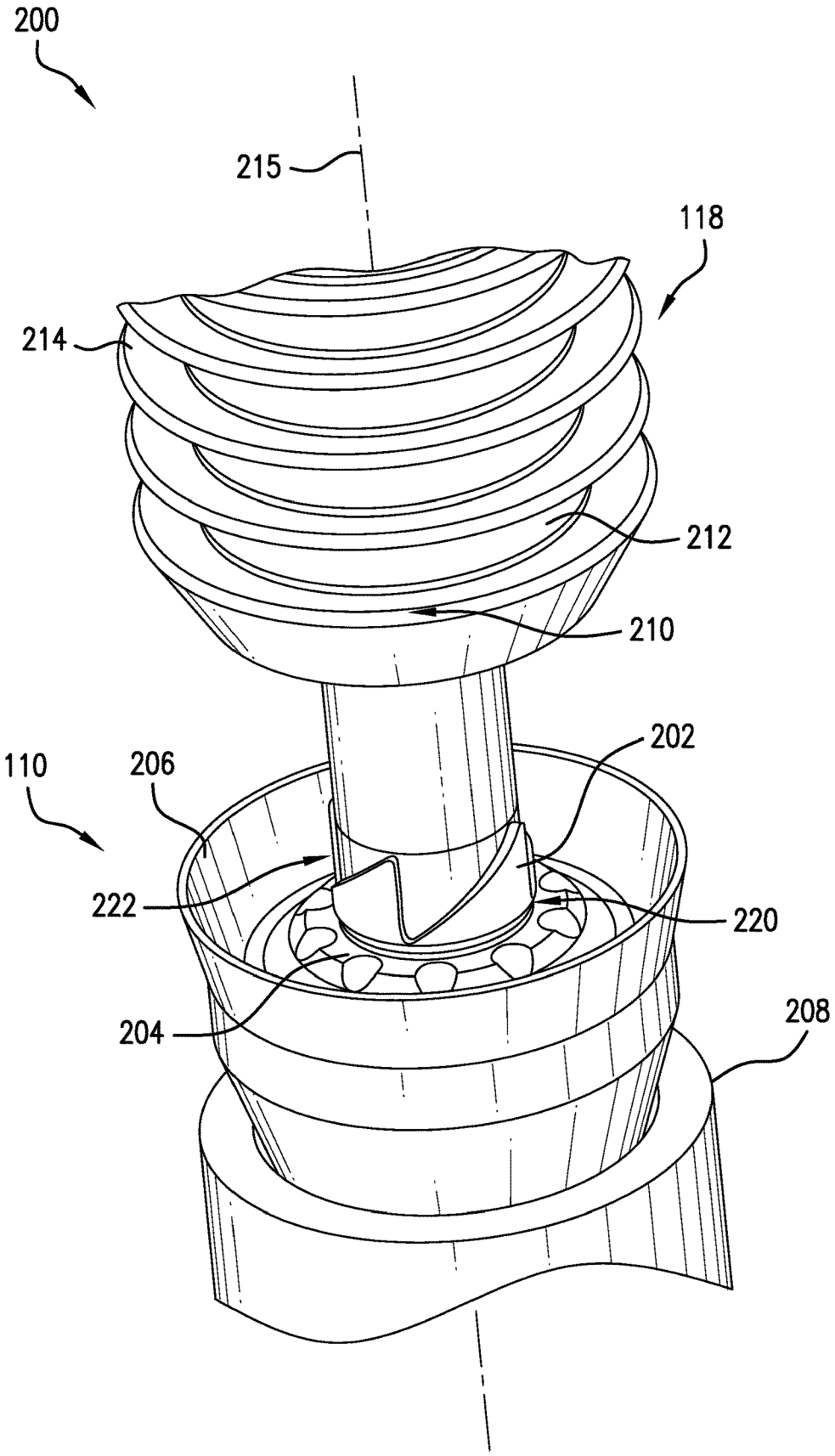
FIG. 2 shows a plug system including the lead plug and follow plug in a joined or mated configuration, in an illustrative embodiment.

FIG. 2 shows a plug system 200 including the lead plug 110 and follow plug 118 in a joined or mated configuration, in an illustrative embodiment. The lead plug 110 includes a locked member 202, such as a longitudinal mandrel or pipe that is prevented from rotating due to the lead plug 110 being locked to the locking device 112. The lead plug 110 further includes a first collar 204 circumferentially surrounding the locked member 202 and fixedly attached to the locked member 202, and a first seal 206 circumferentially surrounding the first collar 204 and fixedly attached to the first collar 204. The first seal 206 includes fins 208 for sweeping a fluid ahead of the lead plug 110. The follow plug 118 includes a free member 210 such as a longitudinal mandrel or pipe. The free member 210 is referred to as "free" to indicate that it is not directly coupled to the casing 102 through any device that prevents it from rotating, besides frictional forces between the follow plug 118 and the casing 102. The follow plug 118 also includes a second collar (not shown) circumferentially surrounding the free member 210 and fixedly attached to the free member 210, and a second seal 212 circumferentially surrounding the second collar and fixedly attached to the second collar. The second seal 212 includes fins 214 for sweeping a fluid such as cement ahead of the follow plug 118. Since the free member 210 is fixedly attached to the rest of the follow plug 118, the free member 210 and the follow plug 118 rotate as a single unit. For illustrative purposes, the follow plug 118 has been moved away from the lead plug 110 in order to reveal the free member 210. In practice, the free member 210 resides within the follow plug 118 at the location shown in FIG. 5 to receive the locked member 202.

Referring still to FIG. 2, the locked member 202 extends along a longitudinal axis 215 and includes a first locking end 220 that is located uphole of the lead plug 110 when the lead plug 110 is disposed within the casing 102. The free member 210 extends along the longitudinal axis 215 and includes a second locking end 222 that is located downhole of the follow plug 118 when the follow plug 118 is disposed within the casing. The first locking end 220 and the second locking end 222 are designed to fit with each other in order to prevent rotation of the follow plug 118 during the drilling out process, as discussed with respect to FIG. 3.

Figure 3:
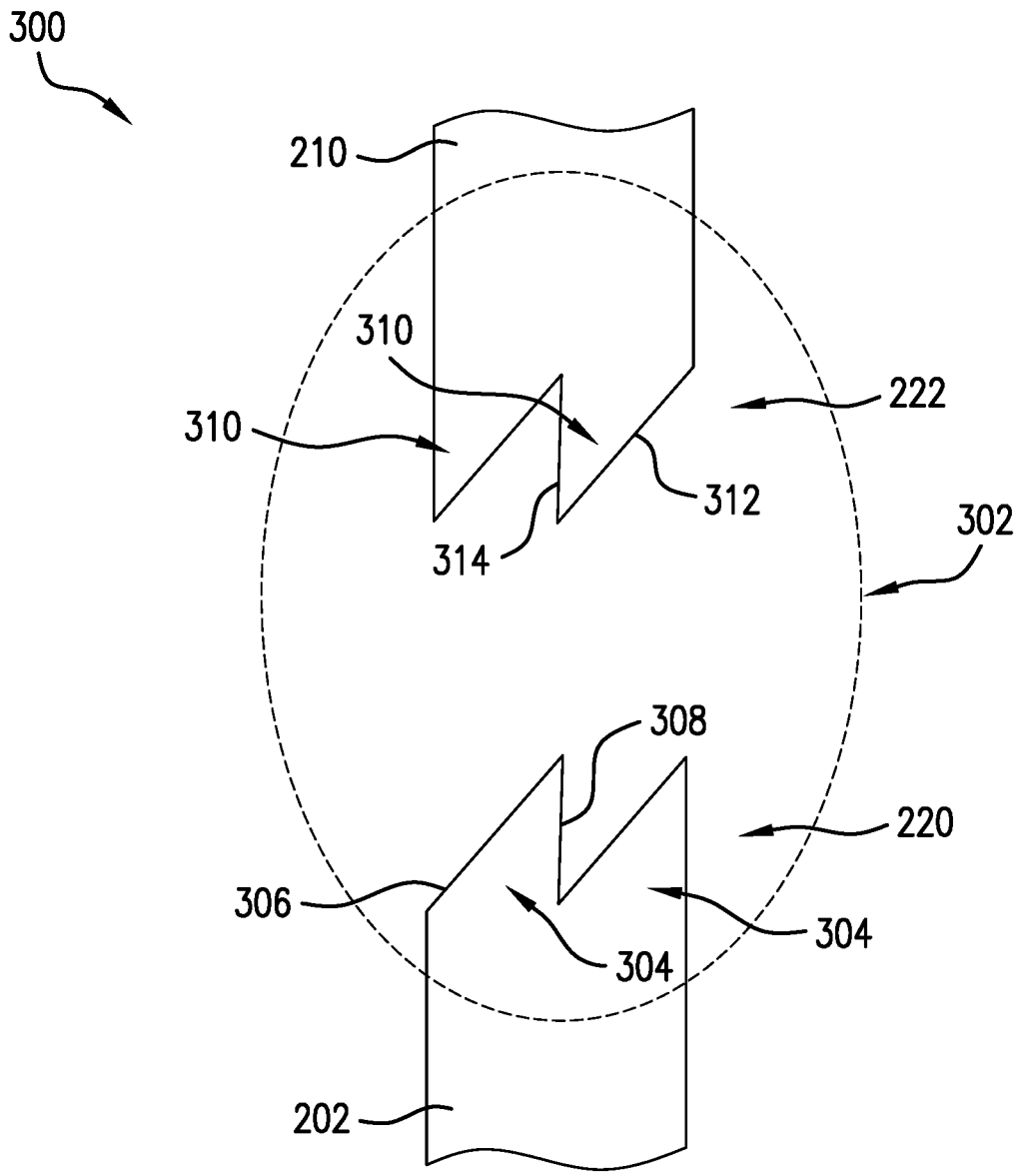
FIG. 3 shows a side view of a junction between a first locking end of a free member the follow plug and a second locking end of a locked member of the lead plug.

FIG. 3 shows a side view 300 of a junction 302 between the first locking end 220 and the second locking end 222. The first locking end 220 includes first anti-rotation features 304, such as gear teeth, that are circumferentially arranged about the first locking end 220. Each first anti-rotation feature 304 includes a first sloped face 306 and a first engaging face 308. The second locking end 222 includes second anti-rotation features 310, such as gear teeth, that are circumferentially arranged about the second locking end 222. Each second anti-rotation feature 310 includes a second sloped face 312 and a second engaging face 314.

In one embodiment, as viewed from the first locking end 220 looking toward the second locking end 222, a first anti-rotation feature 304 is oriented in a counterclockwise direction and a second anti-rotation feature 310 is oriented in a clockwise direction. In other words, a normal to the first engaging face 308 points in a counterclockwise direction and a normal to the second engaging face 314 points in a clockwise direction. In another embodiment, the first anti-rotation feature 304 is oriented in a clockwise direction and the second anti-rotation feature 310 is oriented in a counterclockwise direction. The particular orientation is selected so that a torque applied by a drill bit to the follow plug 118 is resisted by a pressure between the second engaging face 314 against the first engaging face 308, when mated.

A shape of the first anti-rotation feature 304 and a shape of the second anti-rotation feature 310 are complementary, allowing the first locking end 220 to fit into second locking end 222. When the first anti-rotation feature 304 is fit into the second anti-rotation feature 310, the first engaging face 308 of the first locking end 220 is placed against a second engaging face 314 of the second locking end 222, and the first sloped face 306 of the first locking end 220 is placed against the second sloped face 312 of the second locking end 222. A rotating drill bit applies a torque on the follow plug 118, thereby pressing the second engaging face 314 against the first engaging face 308. The lead plug 110, being locked into place in the casing, provides a resistive torque to the follow plug 118 that resists a rotation of the follow plug 118 otherwise produced by the torque from the drill bit. To a lesser degree, the applied torque of the drill bit is resisted by a resistive frictional torque caused by frictional forces between the lead plug 110 and the casing 102 and/or locking device 112. A resistive torque at the lead plug 110 is transmitted from the lead plug 110 to the follow plug 118 via forces between the first engaging face 308 and the second engaging face 314. The follow plug 118 is therefore held in place or prevented from rotating by the lead plug 110. The lead plug 110 prevents, hinders, or resists a rotation of the follow plug 118 along with the drill bit, thereby allowing the drill bit to drill out the follow plug 118 with increased efficiency in comparison to a follow plug 118 that catches or rotates with the drill bit. Since the first anti-rotation feature 304 fits into the second anti-rotation feature 310 without locking the follow plug 118 and lead plug 110 together, the follow plug 118 and lead plug 110 can be separated easily. The anti-rotation features of FIGS. 2 and 3 shows engaging faces that are vertically oriented, i.e., the surface of the first engaging face 308 and the surface of the second engaging face 314 are parallel to the longitudinal axis 215 in FIG. 2. This vertical orientation however is not meant to be a limitation of the invention.

Figure 4:
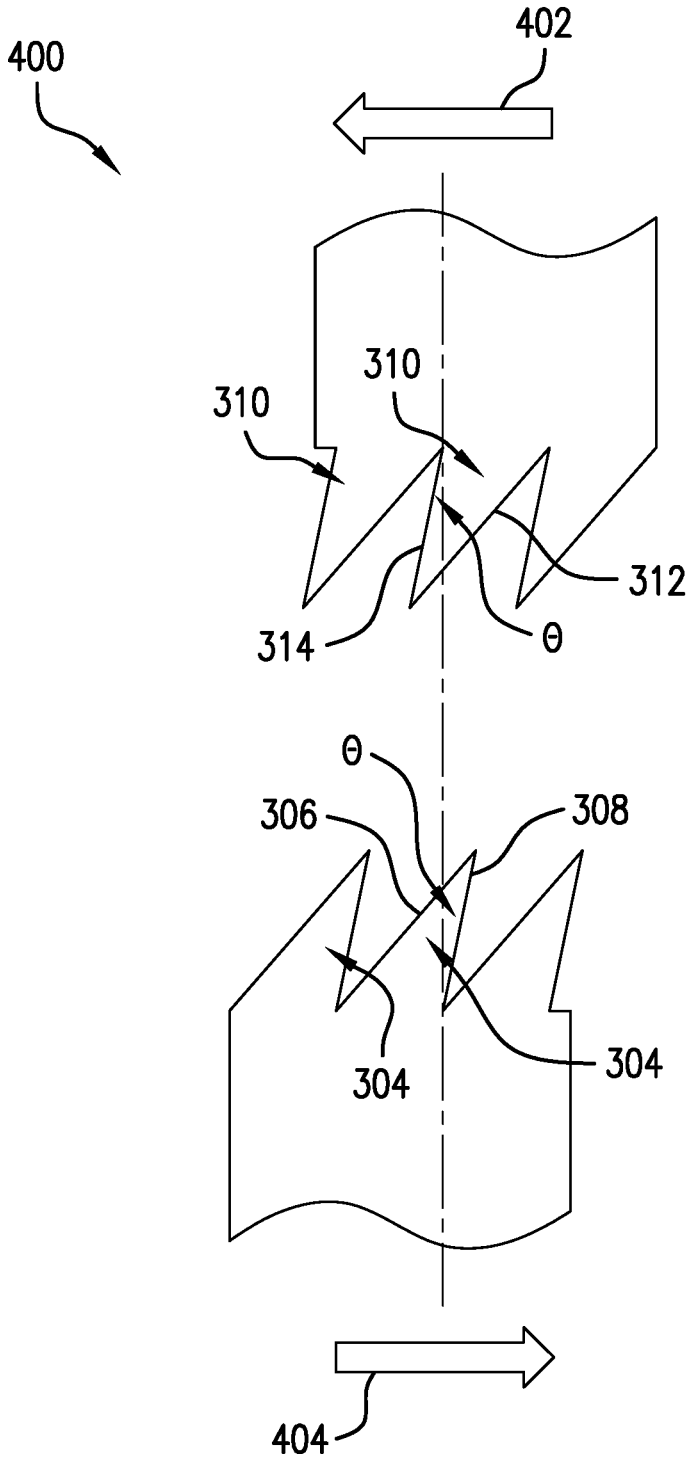
FIG. 4 shows anti-rotation features of the first locking end and the second locking end, in an alternate embodiment.

FIG. 4 shows anti-rotation features in an alternate embodiment. Each of the first anti-rotation features 304 includes a first sloped face 306 and a first engaging face 308. The first engaging face 308 is at an angle θ to the longitudinal axis 215, leaning from root to tip in the direction of resistive torque 404 provided by the lead plug 110. Similarly, each second anti-rotation feature 310 includes a second sloped face 312 and a second engaging face 314. The second engaging face 314 is at the angle θ to the longitudinal axis, leaning from root to tip in the direction of applied torque 402 provided by the drill bit. As the first engaging face 308 intercepts the second engaging face 314, the angle θ causes them to draw the lead plug 110 and follow plug 118 toward each other in the presence of the applied torque 402. In various embodiments, the angle θ is between about 1 degrees and about 15 degrees with respect to the longitudinal axis. When the direction of the applied torque 402 is reversed, the lead plug 110 and follow plug 118 can easily separate.

Figure 5:
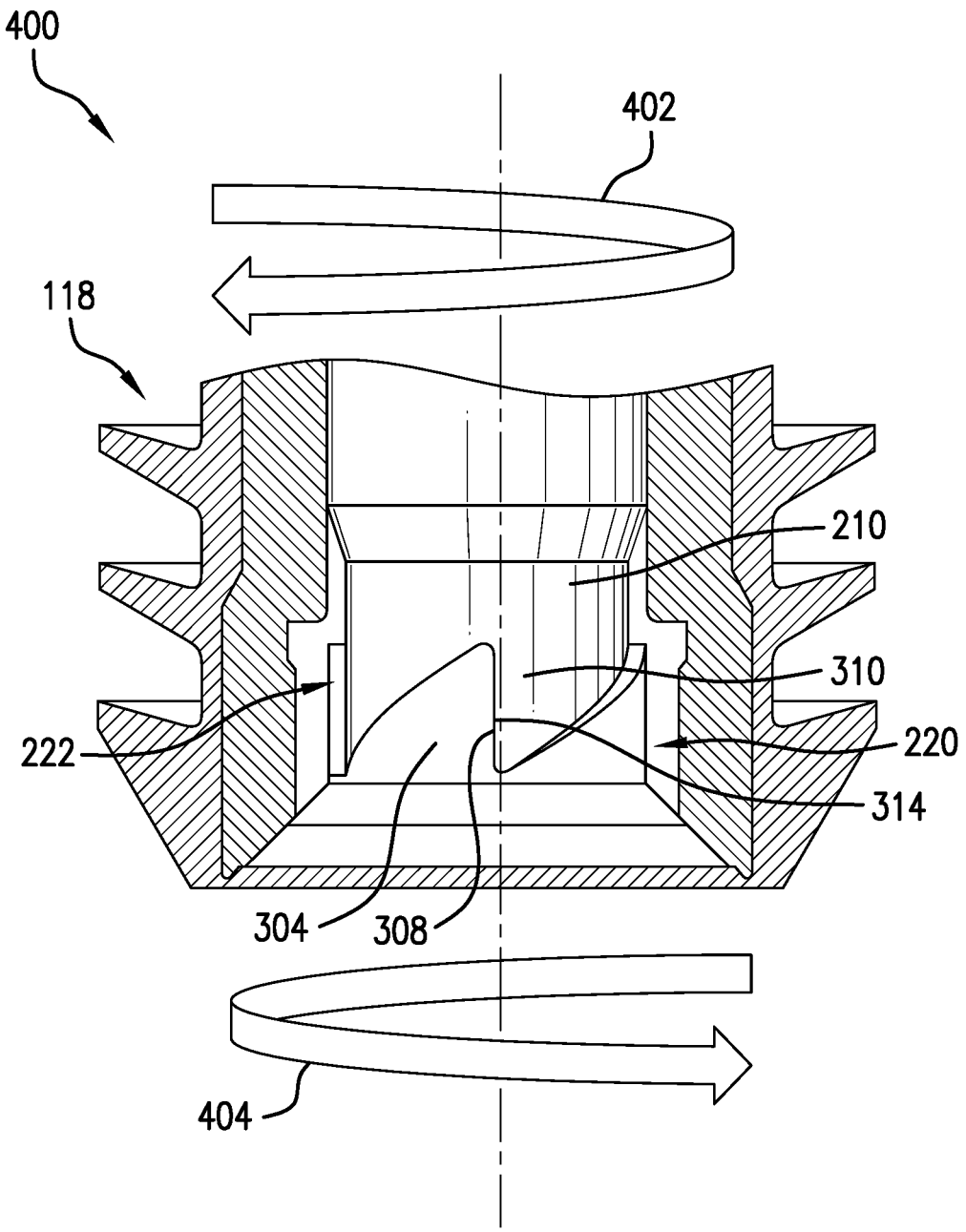
FIG. 5 shows a side view of the follow plug illustrating torques applied to the cement plug system with the first end and second end in a mated configuration.

FIG. 5 shows a side view of the follow plug 118 illustrating torques applied to the cement plug system with the first locking end 220 (of the lead plug 110) and the second locking end 222 (of the follow plug 118) in a mated configuration. As shown in FIG. 5, the second locking end 222 is disposed in a recess within the follow plug 118. The first locking end 220 is inserted into the follow plug 118 in order to mate with or engage with the second locking end 222. A first engaging face 308 of the first anti-rotation feature 304 is pressed against a second engaging face 314 of a second anti-rotation feature 310. Applied torque 402 is applied by the drill bit to the follow plug 118 in the direction shown. Resistive torque 404 is applied by the lead plug 110 in the direction shown. The resistive torque 404 is transferred from the lead plug 110 to the follow plug 118 via the engagement between the first anti-rotation feature 304 and the second anti-rotation feature 310.

Set forth below are some embodiments of the foregoing disclosure:

Embodiment 1: A plug system including a locked member of a first plug, the locked member having a first locking end having a first anti-rotation feature; a free member of a second plug, the free member having a second locking end having a second anti-rotation feature; and wherein the first anti-rotation feature and the second anti-rotation feature are configured to fit together to resist a rotation between the free member and the locked member to thereby resist rotation of the second plug with respect to the first plug.

Embodiment 2: The plug system of any prior embodiment, wherein the first anti-rotation feature includes a first engaging face and the second anti-rotation feature includes a second engaging face.

Embodiment 3: The plug system of any prior embodiment, wherein the second plug receives an applied torque that presses the second engaging face against the first engaging face.

Embodiment 4: The plug system of any prior embodiment, wherein an angle of the first engaging face and of the second engaging face with respect to a longitudinal axis of the plug system is one of: (i) parallel to the longitudinal axis; and (ii) between about 1 degree and 15 degrees with respect to the longitudinal axis.

Embodiment 5: The plug system of any prior embodiment, wherein a resistive torque of the first plug is transmitted to the second plug through the first anti-rotation feature and the second anti-rotation feature.

Embodiment 6: The plug system of any prior embodiment, wherein the first anti-rotation feature is oriented in one of a clockwise direction and a counterclockwise direction and the second anti-rotation feature is oriented in the other of the clockwise direction and the counterclockwise direction.

Embodiment 7: The plug system of any prior embodiment, wherein the first anti-rotation feature is configured to fit into the second anti-rotation feature to resist the rotation of the second plug.

Embodiment 8: The plug system of any prior embodiment, wherein the first plug is a lead plug of the plug system and the second plug is a follow plug of the plug system.

Embodiment 9: A method of cementing a casing including disposing a first plug in the casing, the first plug having a first locking end having a first anti-rotation feature; passing a second plug through the casing to sweep cement out of the casing, the second plug having a second locking end having a second anti-rotation feature; mating the first anti-rotation feature to the second anti-rotation feature; and applying an applied torque to the second plug, wherein the first anti-rotation feature and the second anti-rotation feature are mated to resist a rotation between of the second plug with respect to the first plug.

Embodiment 10: The method of any prior embodiment, wherein the first anti-rotation feature includes a first engaging face and the second anti-rotation feature includes a second engaging face and mating the first anti-rotation feature to the second anti-rotation feature includes placing the first engaging face against the second engaging face.

Embodiment 11: The method of any prior embodiment, further including applying the applied torque to the second plug to press the second engaging face against the first engaging face.

Embodiment 12: The method of any prior embodiment, wherein an angle of the first engaging face and of the second engaging face is between about 1 degree and 15 degrees with respect to a longitudinal axis of a plug system, further comprises applying the torque to draw the first plug and the second plug toward each other.

Embodiment 13: The method of any prior embodiment, further including transmitting a resistive torque of the first plug to the second plug through the first anti-rotation feature and the second anti-rotation feature.

Embodiment 14: The method of any prior embodiment, wherein the first anti-rotation feature is oriented in one of a clockwise direction and a counterclockwise direction and the second anti-rotation feature is oriented in the other of the clockwise direction and the counterclockwise direction.

Embodiment 15: The method of any prior embodiment, wherein the first plug is a lead plug of a plug system and the second plug is a follow plug of the plug system.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A plug system, comprising:

a locked member of a first plug, the first plug extending along a longitudinal axis, the locked member having a first locking end having a first anti-rotation feature having a firm engaging face; and a free member of a second plug, the second plug extending along the axis, the free member having a second locking end having a second anti-rotation feature having a second engaging face; and wherein the first anti-rotation feature and the second anti-rotation feature are configured to fit together so that a resistive torque provided by the locked member and an applied torque provided by the free member press the first engaging face against the second engaging face to resist a rotation between the free member and the locked member to thereby resist rotation of the second plug with respect to the first plug;

wherein the first engaging face loans from root to tip in the direction of the resistive torque to form an angle with respect to the longitudinal axis and the second engaging face leans from root to tip in the direction of an applied torque to forms an angle with respect to the longitudinal axis.

2. The plug system of claim 1, wherein the first plug is locked into a casing to prevent rotation of the first plug.

3. The plug system of claim 2, wherein the second plug receives the applied torque from a drill bit.

4. The plug system of claim 1, wherein the angle of the first engaging face and the angle of the second engaging face with respect to the longitudinal is between about 1 degree and 15 degrees with respect to the longitudinal axis.

5. The plug system of claim 1, wherein the resistive torque of the first plug is transmitted to the second plug through the first anti-rotation feature and the second anti-rotation feature.

6. The plug system of claim 1, wherein the first anti-rotation feature is oriented in one of a clockwise direction and a counterclockwise direction and the second anti-rotation feature is oriented in the other of the clockwise direction and the counterclockwise direction.

7. The plug system of claim 1, wherein the first anti-rotation feature is configured to fit into the second anti-rotation feature to resist the rotation of the second plug.

8. The plug system of claim 1, wherein the first plug is a lead plug of the plug system and the second plug is a follow plug of the plug system.

9. A method of cementing a casing, comprising:

disposing a first plug in the casing, the first plug extending along a longitudinal axis and having a first locking end having a first anti-rotation feature having a first engaging face;

passing a second plug through the casing to sweep cement out of the casing, the second plug extending along the longitudinal axis and having a second locking end having a second anti-rotation feature having a first engaging face;

mating the first engaging face of the first anti-rotation feature to the second engaging face of the second anti-rotation feature; and applying an applied torque to the second plug, wherein a resistive torque provided by the first plug and the applied torque provided by the second plug press the first engaging face against the second engaging face;

wherein the first engaging face leans from root to tip in the direction of the resistive torque to form an angle with respect to the longitudinal axis and the second engaging face leans from root to tip in the direction of an applied torque to forms an angle with respect to the longitudinal axis.

10. The method of claim 9, wherein the first plug is locked into a casing to prevent rotation of the first plug.

11. The method of claim 10, further comprising applying the applied torque to the second plug by a rotating a drill bit.

12. The method of claim 9, wherein the angle of the first engaging face and of the second engaging face is between about 1 degree and 15 degrees with respect to the longitudinal, further comprises applying the torque to draw the first plug and the second plug toward each other.

13. The method of claim 9, further comprising transmitting a resistive torque of the first plug to the second plug through the first anti-rotation feature and the second anti-rotation feature.

14. The method of claim 9, wherein the first anti-rotation feature is oriented in one of a clockwise direction and a counterclockwise direction and the second anti-rotation feature is oriented in the other of the clockwise direction and the counterclockwise direction.

15. The method of claim 9, wherein the first plug is a lead plug of a plug system and the second plug is a follow plug of the plug system.

* * * * *